US007988156B2

(12) United States Patent
Morrison

(10) Patent No.: US 7,988,156 B2
(45) Date of Patent: Aug. 2, 2011

(54) ADDITIVE PUMP

(75) Inventor: James Morrison, Fort St. John (CA)

(73) Assignee: MCI Solar Mfg. Ltd., Fort St. John (CA)

( * ) Notice: Subject to any disclaimer, the term of this patent is extended or adjusted under 35 U.S.C. 154(b) by 313 days.

(21) Appl. No.: 11/761,253

(22) Filed: Jun. 11, 2007

(65) Prior Publication Data

US 2007/0283806 A1 Dec. 13, 2007

Related U.S. Application Data

(60) Provisional application No. 60/812,111, filed on Jun. 9, 2006.

(51) Int. Cl.
*F16J 9/00* (2006.01)
*F16J 15/00* (2006.01)

(52) U.S. Cl. ..... 277/435; 277/500

(58) Field of Classification Search ..... 277/434, 277/435, 437, 449, 489, 500, 510, 511, 514
See application file for complete search history.

(56) References Cited

U.S. PATENT DOCUMENTS

| | | | | |
|---|---|---|---|---|
| 4,071,254 | A * | 1/1978 | Raimondi et al. | 277/347 |
| 6,422,569 | B1 * | 7/2002 | Comes et al. | 277/437 |
| 2004/0056424 | A1 * | 3/2004 | Busse et al. | 277/430 |
| 2004/0206229 | A1 * | 10/2004 | Morrison | 91/348 |
| 2004/0227301 | A1 * | 11/2004 | Wood et al. | 277/434 |
| 2005/0087935 | A1 * | 4/2005 | Hughes | 277/610 |

* cited by examiner

*Primary Examiner* — Vishal Patel
(74) *Attorney, Agent, or Firm* — John R. S. Orange; Blake, Cassels & Graydon LLP

(57) ABSTRACT

A seal assembly, for an additive pump having a reciprocating piston, is provided. The seal assembly includes a seal carrier having first and second components each having a bore therein to receive the piston. Each component has an end face arranged to abut one another when arranged axially on the piston, and a face seal is interposed between the end faces to inhibit egress of fluid between the end faces. A pair of circumferential seals at axially spaced locations are provided along the seal carrier and operable to engage the piston during reciprocating thereof, and a drain port intersecting one of the bores intermediate the seals is provided to permit egress of fluid from between the seals.

8 Claims, 3 Drawing Sheets

ADDITIVE PUMP

CROSS-REFERENCE TO RELATED APPLICATIONS

This application claims priority from U.S. Provisional Application No. 60/812,111 filed on Jun. 9, 2006 and is hereby incorporated by reference.

FIELD OF THE INVENTION

The present invention relates to injection pumps, in particular to injection pumps for injecting an additive into a pipeline.

SUMMARY OF THE INVENTION

It is well known to inject an additive into a fluid pipeline, such as a gas pipeline to enhance the serviceability of the pipeline. Typically, such additives are injected to inhibit corrosion or to enhance lubrication of components in the pipeline. The additive is injected in relatively small volumes compared to the volume of fluid carried by the pipeline but the additive's effect is significant.

The additives need to be injected periodically into the fluid and, as such, additive stations are placed at spaced locations along the length of the pipeline. Because of the nature of the pipeline and the terrain through which it must pass, the additive stations are typically located in remote areas and beyond access to normal services. The injection stations must therefore be self contained and capable of working without undue supervision over long periods of time.

The siting of additive stations at remote locations also requires the environmental impact of such stations to be minimized. The additives may in some cases be toxic or potentially hazardous and accordingly it is necessary to ensure that any spillage of such additives is minimized.

One such an arrangement that addresses these concerns is shown in U.S. patent application Ser. No. 10/742,792 in which the fluid in the pipeline is used as a motive force for an injection pump and the fluid is returned to the pipeline to avoid any egress into the atmosphere. The motive force available from such an arrangement is significant due to the pressure differential that exists in the pipeline and accordingly conventional sealing can be utilized within the plunger to inhibit leakage of additives.

In some circumstances the use of the fluid in the pipeline is not desirable or available and in such circumstances an alternative arrangement of pump is required. It has been proposed to utilize a battery powered pump with the battery being recharged from solar cells. With this arrangement however the conventional sealing arrangement used on additive pumps imposes a high load upon the piston of the pump and thereby increases the energy consumption of the additive station beyond that that may typically be available from a solar powered source. Conventional sealing arrangements utilize a packing gland whose sealing capability depends in part on the radial load applied to the shaft on which it is mounted. Such seals are relatively easy to install but impose significant drag on the piston. There is also a need with such additive pumps to provide control of the injection rate of the additive to suit varying conditions and for adjustment of that rate from station to station as circumstances differ.

It is therefore an object of the present invention to provide an additive pump in which the above disadvantages are obviated or mitigated.

BRIEF DESCRIPTION OF THE DRAWINGS

An embodiment of the invention will now be described by way of example only with reference to the accompanying drawings in which.

DETAILED DESCRIPTION OF THE INVENTION

Figure 1:
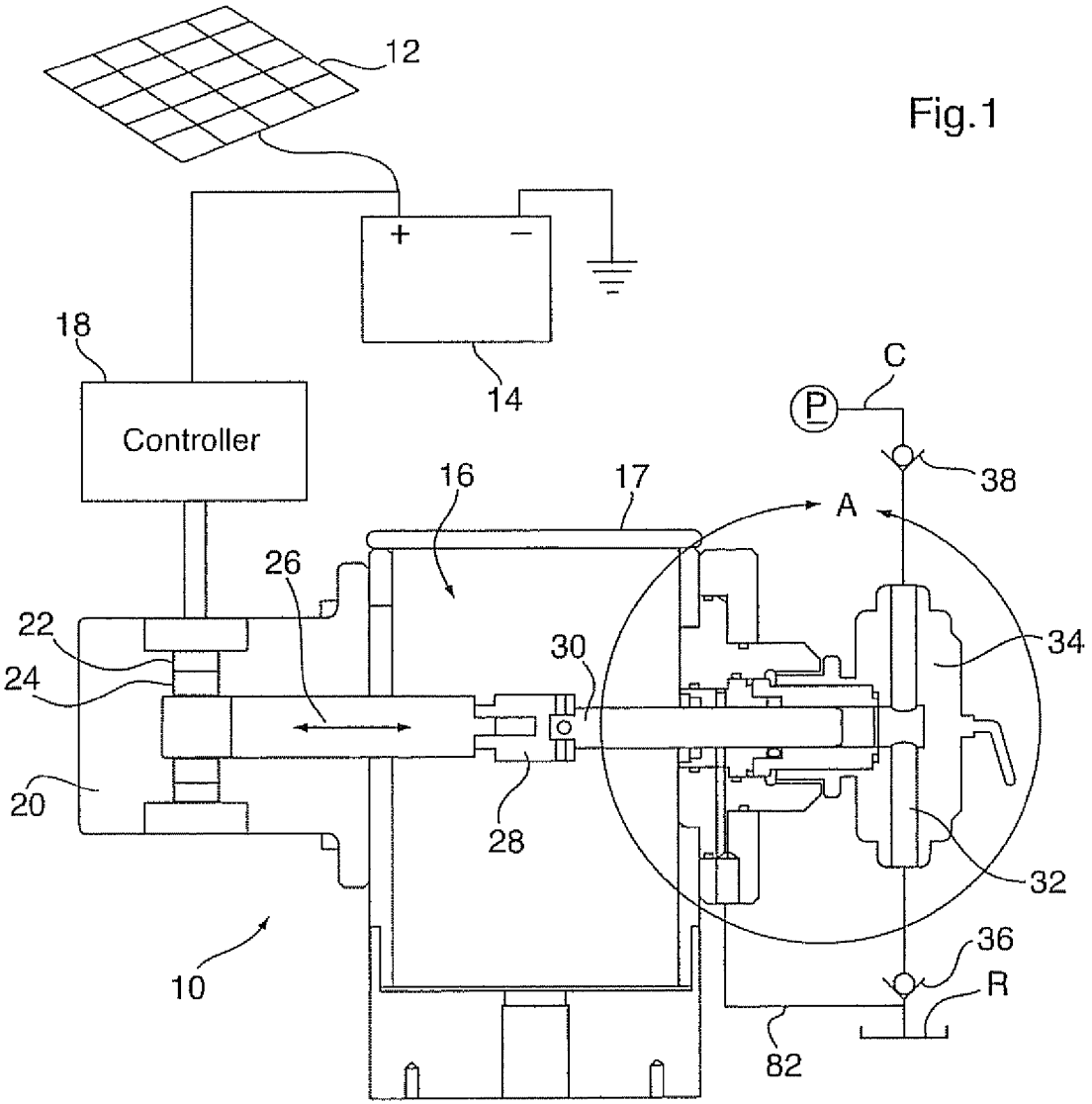
FIG. 1 is a general side view showing an additive station.

Referring therefore to FIG. 1, a pipeline indicated at P is supplied with an additive from a reservoir R through a conduit C. The additive is moved through the conduit C by an additive pump assembly generally indicated 10. Energy for the operation of the pump assembly 10 is obtained from a solar panel 12 that is used to charge a battery 14 and provide a reserve of electrical energy for the assembly 10.

The assembly 10 includes a pump 16 located in a housing 17 and a controller 18 that controls the operation of the pump 16. The pump 16 includes a stepper motor 20 that is controlled by the controller 18 as will be described in more detail below. The stepper motor is available from Haydon Switch and Instrument, PO Box 3329, 1500 Meridian Road, Waterbury Connecticut 06705, under the Series 57000, size 23 and Series 87000, size 34 motors. The motor 20 includes an armature that cooperates with a drive shaft 24 through a lead screw 25. Rotation of the drive shaft 24 is inhibited so that rotation of the armature 22 induces a linear axial displacement of the drive shaft 24 through the action of the lead screw 25.

The drive shaft 24 is connected to a transfer shaft 26 that is attached through a coupling 28 to a piston 30. The coupling 28 is of known construction that permits alignment between the transfer shaft 26 and the piston 30 and inhibits lateral loads being placed upon the piston during reciprocal movement. The piston 30 communicates with a pumping chamber 32 of a positive displacement fluid end 34 that may be of any convenient form known in the industry. The fluid end 34 incorporates an inlet check valve 36 and an outlet check valve 38 to ensure transfer of fluid from the reservoir R to the pipeline P as the piston 30 reciprocates.

Figure 2:
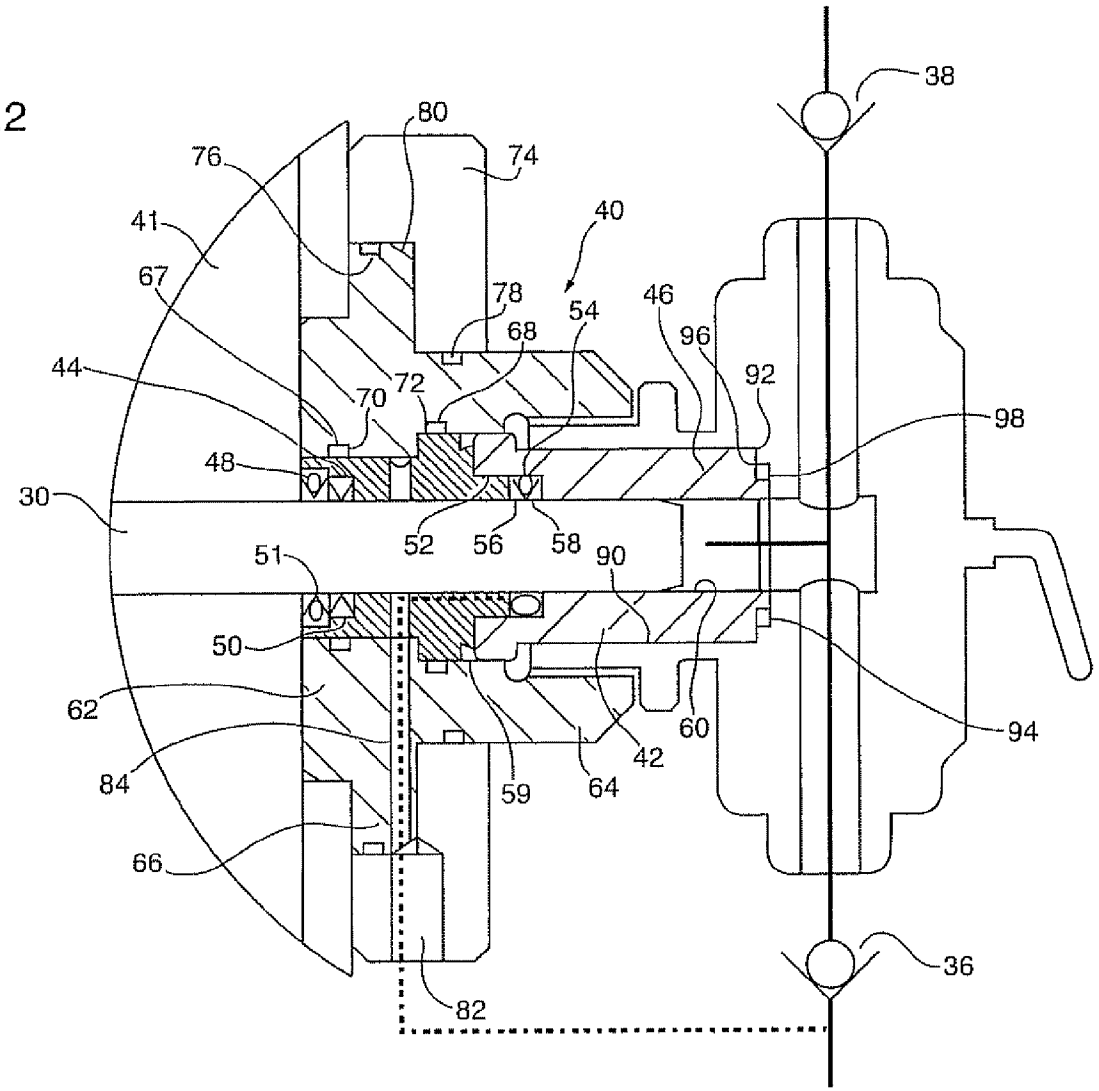
FIG. 2 is an enlarged sectional view of the portion of FIG. 1 shown within the circle identified as II.

The connection of the fluid end 34 to the piston 30 is best seen in FIG. 2. The piston 30 is slidably supported in a seal assembly 40 that is supported on an end face 41 of pump housing 17. The seal assembly 40 includes a seal carrier 42 formed from an inner sleeve 44 and an outer nose 46. The sleeve 44 and nose 46 are axially aligned to define a central bore 60 in which the piston 30 is a close sliding fit. The bore 60 is in fluid communication with the pumping chambers 32 so that reciprocal motion of the piston 30 within the bore 60 induces flow from the reservoir R to the pipeline P.

The sleeve 44 has a pair of stepped counter bores 48, 49 formed at one end adjacent to the wall 42 to carry circumferential lip seals 50, 51. The seal 50 acts as a wiper to prevent contaminants from entering the central bore 60 and the seal 51 acts as a seal to inhibit egress of fluid from the chamber 60. The opposite end of the sleeve 44 has a reduced shoulder 52 that is nested within a counter bore 54 of the nose 46. The shoulder 52 and counter bore 54 define a cavity 56 in which a circumferential lip seal 58 is carried and functions in a manner to the seal 51 to prevent egress of fluid. It will be noted that the lip seals 50, 51, 58 are located at opposite end faces of the sleeve 44 so that the seals can be readily assembled.

The outer surface of the sleeve 44 has an undercut recess 57 in which a face seal 59 is located to but against the radial face of one end of the nose 46. The face seal therefore provides a static seal between the two components of the carrier, namely the sleeve 44 and nose 46. Again therefore, the seal may be easily assembled with the seal carrier.

The sleeve 44 and nose 46 are supported in a collar 62 having a central boss 64 and a radial flange 66. The boss 64 is counter bored to receive the sleeve 44 and nose 46 and has a pair of circumferential grooves, 67, 68 that locate static seals 70, 72 to seal between the nose 44 and the counter bore of the boss 64.

The radial flange 66 is located against the wall 42 by a retaining cap 74 with a seal 76 sealing between the cap 74 and the radial outer face of the flange 66. A similar seal 78 is provided between the outer surface of the boss 64 and the cap to ensure fluid tight fitting. The outer surface of the flange 66 is bevelled as indicated at 80 to define an annular gallery that is intersected by a drainage port 82. The drainage port also communicates through cross drillings 84 with the bore 60 at a location between the two seals 51, 58. Any fluid entering between the two seals is therefore drained by the port 82 to the reservoir R as shown in FIG. 1.

The inner surface of the boss 64 is threaded to receive a threaded male fitting 86 of the fluid end 34. The fluid end 34 has a elongate cylindrical recess 90 into which the nose 46 is a sliding fit. The distal end of the nose 46 is undercut to provide a notch 92 to form a seat for a high pressure face seal 94. The notch 92 has a radial face 96 that opposes a complimentary radial face 98 on the fluid end so that the seal 94 is held between a pair of radial faces. Rotation of the fluid end within the boss 64 therefore applies a compressive load to the nose 46 and sleeve 44 to maintain the face seals 59,94 in compression.

In operation, reciprocation of the piston 30 within the bore 60 causes fluid to be initially drawn into the chamber 32 through a check valve 36 as the piston 30 is retracting and subsequently to expel fluid from the bore 60 through the check valve 38 as the piston 30 advances. During such reciprocal motion, the seals 50, 58 bear against the piston but in view of the fact that the piston itself is a close sliding fit within the bore and the seals utilized are preferably a lip seal, the passage of fluid past the seals is minimal. The drag on the piston due to the use of the pair of seals is also minimized and therefore the piston 30 has relatively low resistance to such axial movement. Any fluid that does pass through the seal 58 is drained through the port 82 back to the reservoir and thereby inhibits any loss of the additive during the pumping action.

The seal carrier 42 itself provides a sealed environment to inhibit egress of fluid under high pressure by providing a pair of face seals between radially opposed faces of the seal carrier. The seal 94 and seal 59 effectively inhibit the flow of fluid radially outwardly beyond the seal carrier 42 due to the compressive loads that act on the seals. It will also be noted that by forming the seal carrier in two parts namely the sleeve 44 and the nose 46, the seal 59 is readily located on the seal carrier as is the face seal 94. Accordingly, the optimum installation and sealing conditions can be provided for the face seals without inhibiting the operation of the piston. The seal 58 is preferably a dynamic spring energized rod seal with a high density, solvent resistant polymer sealing material. Such seals are capable of providing 90% sealing efficiency at pressures greater than 3200 psi. The seals 50, 51 are lower pressure lip seals designed to operate at slightly elevated pressures and essentially inhibiting the carriage of fluids on the piston into or from the housing. The face seals 59, 94 are static face seals of the O-ring type which provide 100% sealing at pressures over 3200 psi.

Figure 3:
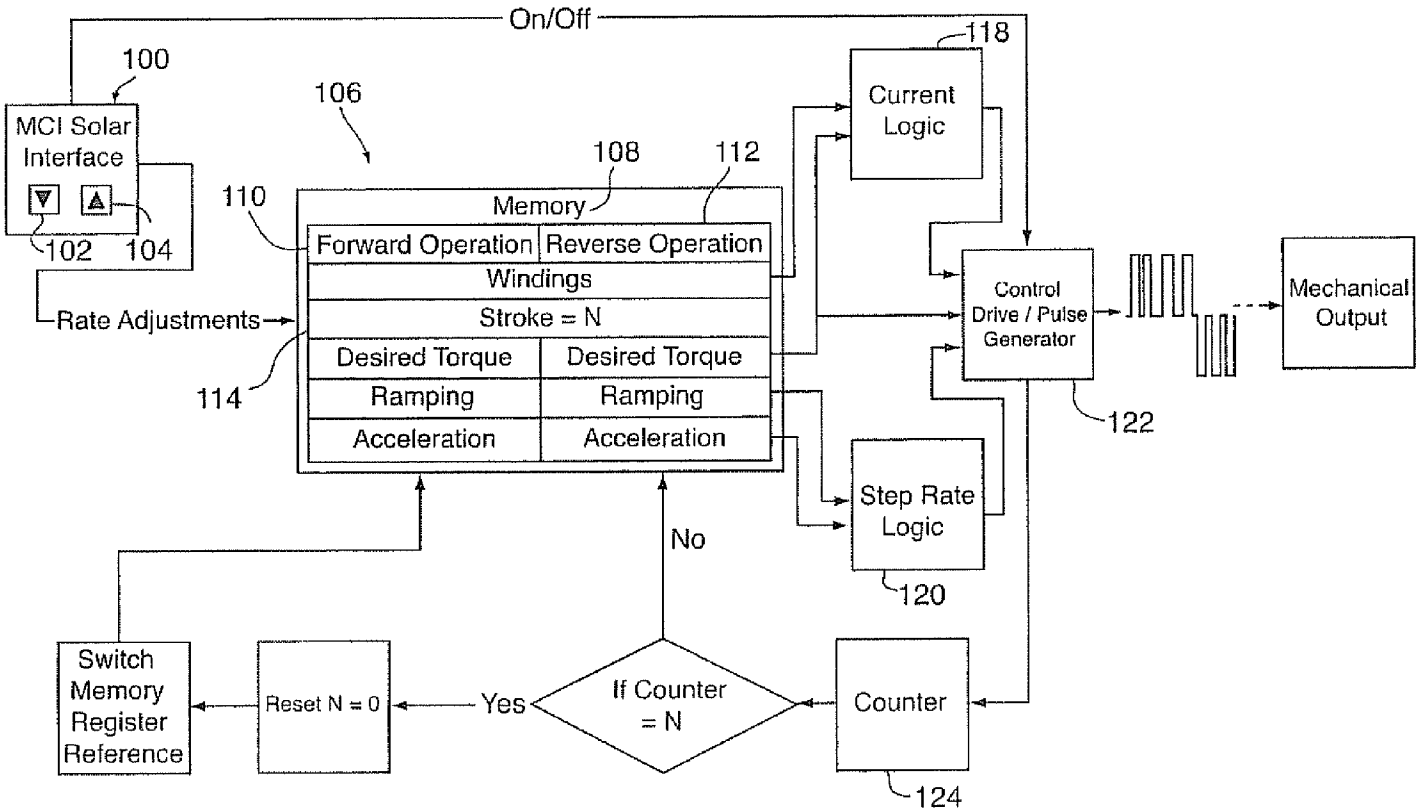
FIG. 3 is a schematic representation of the controller shown in FIG. 1.

As noted above, reciprocal motion of the piston 30 is derived from the stepping motor 20. The controller 18 provides control pulses through the field coils of the motor 20 which in turn produce a defined rotational output. By varying the frequency of the pulses and their polarity, the rate of rotation of the armature and its direction of rotation may be regulated as illustrated in FIG. 3.

The controller 18 has a program more programmable interface 100 providing keys 102, 104 to permit adjustment of the control. The interface 100 communicates with a processor 106 that includes memory 108. The memory has a pair of registers, one for forward operation 110 and the other for reverse operation 112. Each of the registers 110, 112 includes settings for the torque required, the ramping of the onset of the torque and the acceleration required. The memory 108 also includes a stroke setting 114 that determines the number of pulses that constitute the full stroke of the piston. Each of these setting are manually adjustable through the interface 100.

The current supplied to the field windings of the motor 20 is determined by the current logic module 118. The rate at which the current is supplied is determined from the ramping and acceleration values in the registers 110, 112. The modules 118, 120 are used to drive a pulse generator 122 that outputs pulses of the appropriate amplitude, frequency and polarity to drive the armature in the desired direction of the desired rate. The pulses generated by the pulse generator 122 are monitored by a counter 124 and used to control the selection of the registers 110, 112. Each time the counter 124 attains a value corresponding to that of the stroke register 114, the register currently in use is terminated and the other register condition is loaded in through the modules 118, 120 to reverse the direction of motion.

By providing separate adjustment of the forward and reverse motion, different rates of movement can be attained and, with a rapid retraction of the piston, a substantially continuous injection of fluid can be attained if required.

The manual interface 100 permits the selection and setting of the conditions implemented by the control logic. The controller may be implemented on a control logic unit available from Trinanic Motion Control GmbH and Co. KG of Hamburg, Germany.

It will be see therefore that the use of the controller provides enhanced flexibility over the rate of injection and in particular with a differential rate of advance and retraction to permit enhanced control. The provision of the seal assembly with minimal resistance to motion also ensures that the current available from the solar source and batteries is sufficient for continuous operation.

As described above, the reciprocation of the piston 30 is a linear reciprocation with the drive shaft 24 secured to the housing of motor 20. To enhance the performance and life of the seals, it is also possible to incorporate into the coupling 28 a helical drive such that the linear reciprocation of the transfer shaft 26 is converted to a helical motion of the piston 30 thus, the piston will both rotate and move axially past the seals 50, 51, 58 to further in prolong the life of the seals.

The preferred embodiment of seal assembly has been described in conjunction with a solar powered electrical supply and controller. It will be appreciated, however, that the seal assembly may be used with other forms of drive of plunger and may be used as a retrofit to existing seal assemblies used on additive pumps.

What is claimed is:

1. A seal assembly for an additive pump having a reciprocating piston, said seal assembly including a seal carrier having first and second components each having a bore that receives said piston, each component having an end face arranged to abut one another when arranged axially on said piston, a face seal interposed between said end faces to provide a static seal between said first and second components and to inhibit egress of fluid between said end faces, a pair of circumferential seals at axially spaced locations along said seal carrier that engage said piston, and a drain port intersecting one of said bores intermediate said circumferential seals to permit egress of fluid from between said circumferential seals.

2. A seal assembly according to claim 1 wherein said face seal is located in an undercut of one of said components.

3. A seal assembly according to claim 1 wherein one of said circumferential seals is located in a recess formed between said end faces.

4. A seal assembly according to claim 3 wherein another of said circumferential seals is located in an oppositely directed end face on one of said components.

5. A seal assembly according to claim 4 wherein said other circumferential seal is located in a recess formed on said oppositely directed end face.

6. A seal assembly according to claim 1 wherein an additional circumferential seal is located on one of said components.

7. A seal assembly according to claim 6 wherein one of said circumferential seals is located in a recess formed between said end faces of said components and the other of said circumferential seals are located in a counter bore formed in an oppositely directed end face of one of said components.

8. A seal assembly according to claim 1 wherein a second face seal is located on an oppositely directed end face of one of said components.

* * * * *